US008529011B2

(12) United States Patent
Govyadinov

(10) Patent No.: US 8,529,011 B2
(45) Date of Patent: Sep. 10, 2013

(54) DROP DETECTION MECHANISM AND A METHOD OF USE THEREOF

(75) Inventor: Alexander Govyadinov, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1067 days.

(21) Appl. No.: 12/079,338

(22) Filed: Mar. 25, 2008

(65) Prior Publication Data

US 2009/0244163 A1 Oct. 1, 2009

(51) Int. Cl.
*B41J 29/393* (2006.01)

(52) U.S. Cl.
USPC ..... 347/19

(58) Field of Classification Search
USPC ..... 347/19, 81
See application file for complete search history.

(56) References Cited

U.S. PATENT DOCUMENTS

| | | | | |
|---|---|---|---|---|
| 4,422,719 | A | | 12/1983 | Orcutt |
| 5,304,814 | A | | 4/1994 | Markham |
| 5,428,218 | A | | 6/1995 | Toughlian et al. |
| 5,589,858 | A | * | 12/1996 | Kadowaki et al. ..... 347/14 |
| 5,621,524 | A | | 4/1997 | Mitani |
| 5,742,303 | A | | 4/1998 | Taylor et al. |
| 5,774,141 | A | | 6/1998 | Cooper et al. |
| 5,856,833 | A | | 1/1999 | Elgee et al. |
| 5,896,145 | A | | 4/1999 | Osborne et al. |
| 6,088,134 | A | | 7/2000 | Schmidt |
| 6,168,258 | B1 | | 1/2001 | Lou et al. |
| 6,299,275 | B1 | | 10/2001 | Elgee |
| 6,513,900 | B2 | | 2/2003 | Endo et al. |
| 6,517,184 | B1 | | 2/2003 | Bruch et al. |
| 6,525,863 | B1 | | 2/2003 | Riza |
| 6,565,179 | B1 | | 5/2003 | Bruch et al. |
| 6,585,349 | B1 | | 7/2003 | Lou et al. |
| 6,648,444 | B2 | | 11/2003 | Valero et al. |
| 6,747,684 | B2 | | 6/2004 | Ornellas et al. |
| 6,767,122 | B2 | | 7/2004 | Honguh et al. |
| 6,769,756 | B2 | | 8/2004 | Su et al. |
| 6,786,626 | B2 | | 9/2004 | Wu et al. |
| 6,802,580 | B2 | | 10/2004 | Valero |
| 6,814,422 | B2 | | 11/2004 | Bruch et al. |

(Continued)

FOREIGN PATENT DOCUMENTS

| | | |
|---|---|---|
| JP | 2001113725 | 4/2001 |
| JP | 200583769 A1 | 3/2005 |

(Continued)

OTHER PUBLICATIONS

Svanholm, Erik, "Printability and Ink-Coating Interactions in Inkjet Printing," Dissertation, Karlstad University Studies 2007:2, pp. 58 (Feb. 2007).

(Continued)

*Primary Examiner* — Lamson Nguyen

(57) ABSTRACT

A drop detection mechanism and method of use thereof is disclosed. In an embodiment, a shaped laser beam is employed to scatter light off of ink drops that are fired from a plurality of nozzles. A low cost, high throughput detector is utilized to detect the individual drops and thereby calculate the drop count, drop velocity and other drop characteristics. Consequently, through the use of the below described embodiments, new levels of print image quality are enabled on a broad range of inkjet printers, including industrial and web printers.

19 Claims, 9 Drawing Sheets

(56) References Cited

U.S. PATENT DOCUMENTS

| | | | | |
|---|---|---|---|---|
| 6,851,816 | B2 | 2/2005 | Wu et al. | |
| 6,877,838 | B2 | 4/2005 | Elgee | |
| 6,935,717 | B2 | 8/2005 | Su et al. | |
| 6,966,664 | B2 | 11/2005 | Wu | |
| 6,969,159 | B2 | 11/2005 | Su et al. | |
| 6,984,013 | B2 | 1/2006 | Arqullevich et al. | |
| 7,055,925 | B2 | 6/2006 | Subirada et al. | |
| 7,125,151 | B2 | 10/2006 | Uemura et al. | |
| 7,140,762 | B2 | 11/2006 | Wu et al. | |
| 7,249,830 | B2 | 7/2007 | Hawkins et al. | |
| 7,267,467 | B2 | 9/2007 | Wu et al. | |
| 7,287,824 | B2 | 10/2007 | Subirada et al. | |
| 7,287,833 | B2 | 10/2007 | Howard | |
| 7,364,276 | B2 | 4/2008 | Piatt et al. | |
| 7,434,919 | B2 | 10/2008 | Hawkins et al. | |
| 7,442,180 | B2 | 10/2008 | Vitello et al. | |
| 7,452,053 | B2 | 11/2008 | Valles et al. | |
| 7,490,918 | B2 | 2/2009 | Nagashima | |
| 7,513,616 | B2 | 4/2009 | Lin | |
| 7,832,822 | B2 | 11/2010 | Kiyama et al. | |
| 2001/0019480 | A1 | 9/2001 | Fujino et al. | |
| 2003/0193608 | A1 | 10/2003 | Yen | |
| 2003/0218648 | A1* | 11/2003 | Barnes et al. | 347/19 |
| 2004/0254527 | A1 | 12/2004 | Vitello et al. | |
| 2005/0021244 | A1 | 1/2005 | Nicoli et al. | |
| 2005/0024410 | A1 | 2/2005 | Subirada et al. | |
| 2005/0253890 | A1 | 11/2005 | Nagashima | |
| 2006/0103691 | A1 | 5/2006 | Dietl et al. | |
| 2006/0120098 | A1 | 6/2006 | Ikeda et al. | |
| 2006/0139392 | A1 | 6/2006 | Fernandez et al. | |
| 2006/0187651 | A1 | 8/2006 | Kim et al. | |
| 2006/0279601 | A1 | 12/2006 | Unosawa et al. | |
| 2007/0024658 | A1 | 2/2007 | Diol et al. | |
| 2007/0030300 | A1 | 2/2007 | Jeong | |
| 2007/0064068 | A1 | 3/2007 | Piatt et al. | |
| 2008/0180471 | A1 | 7/2008 | Han | |
| 2008/0246803 | A1 | 10/2008 | Barger et al. | |
| 2009/0027459 | A1 | 1/2009 | Hawkins et al. | |
| 2009/0091595 | A1 | 4/2009 | Hayashi et al. | |
| 2009/0141057 | A1 | 6/2009 | Hayashi et al. | |
| 2009/0179934 | A1 | 7/2009 | Takagi et al. | |
| 2009/0244141 | A1 | 10/2009 | Govyadinov et al. | |
| 2009/0273620 | A1 | 11/2009 | Govyadinov et al. | |
| 2009/0310206 | A1 | 12/2009 | Gluckstad | |
| 2010/0207989 | A1 | 8/2010 | Govyadinov | |
| 2011/0090275 | A1 | 4/2011 | Govyadinov et al. | |
| 2012/0013906 | A1 | 1/2012 | Govyadinov et al. | |

FOREIGN PATENT DOCUMENTS

| | | |
|---|---|---|
| JP | 2006047235 | 2/2006 |
| JP | 2006346906 | 12/2006 |
| JP | 2007111971 | 5/2007 |
| WO | 2007015808 | 2/2007 |
| WO | 2009120436 | 10/2009 |

OTHER PUBLICATIONS

International Search Report and Written Opinion, PCT/US2009/034892, Mailing Date Jul. 28, 2009.
The Restriction Requirement for U.S. Appl. No. 12/381,873 mailed on Sep. 29, 2010 (6 pages).
The Restriction Requirement for U.S. Appl. No. 12/388,805 mailed on Jul. 14, 2011 (6 pages).
The Office Action for U.S. Appl. No. 12/254,864 mailed on Jun. 11, 2010 (23 pages).
The Office Action for U.S. Appl. No. 12/381,873 mailed on Feb. 4, 2011 (12 pages).
The Office Action for U.S. Appl. No. 12/388,805 mailed on Aug. 25, 2011 (19 pages).
The Office Action for U.S. Appl. No. 12/381,873 mailed on Sep. 1, 2011 (11 pages).
The Notice of Allowance for U.S. Appl. No. 12/254,864 mailed on Dec. 1, 2010 (12 pages).
McLeod, Euan et al., "Complex Beam Sculpting with Tunable Acoustic Gradient Index Lenses," SPIE, Complex Light Optical Forces, vol. 6483, pp. 19 (2007).
The Office Action for U.S. Appl. No. 12/388,805 mailed Oct. 17, 2012 (10 pages).
The Final Office Action for U.S. Appl. No. 12/388,805 mailed Jan. 13, 2012 (14 pages).
The Advisory Action for U.S. Appl. No. 12/388,805 mailed Mar. 19, 2012 (3 pages).
The Notice of Allowance for U.S. Appl. No. 12/381,873 mailed Feb. 8, 2012 (15 pages).
The Notice of Allowance for U.S. Appl. No. 12/837,098 mailed Sep. 10, 2012 (8 pages).
The Office Action for U.S. Appl. No. 12/837,098 mailed Apr. 26, 2012 (20 pages).
The Office Action for U.S. Appl. No. 12/581,712 mailed Oct. 15, 2012 (25 pages).

* cited by examiner

DROP DETECTION MECHANISM AND A METHOD OF USE THEREOF

BACKGROUND

Generally, drop detection devices are used to detect ink drops ejected by printhead nozzles. Based on the detection of ink drops, the status of a particular nozzle may be diagnosed. Typically, a printhead ejects ink drops in response to drive signals generated by print control circuitry in a printer. A printhead that ejects ink drops in response to drive signals may be referred to as a drop on demand printhead. Typically, there are two commonly used drop on demand technologies. These technologies are thermal (or bubble-jet) inkjet printing and piezo-electric (or impulse) inkjet printing. In thermal inkjet printing, the energy for ink drop ejection is generated by resistor elements, which are electrically heated. Such elements heat rapidly in response to electrical signals controlled by a microprocessor and creates a vapor bubble that expels ink through one or more nozzles associated with the resistor elements. In piezo-electric inkjet printing, ink drops are ejected in response to the vibrations of a piezo-electric crystal. The piezo-electric crystal responds to an electrical signal controlled by a microprocessor.

Nozzles through which ink drops are ejected may become clogged with paper fibers or other debris during normal operation. The nozzles may also become clogged with dry ink during prolonged idle periods. Generally, printhead service stations are used for wiping the printhead and applying suction to the printhead to clear out any blocked nozzles. The ink drop detectors may be used to determine whether a printhead actually requires cleaning. Additionally the detectors may be used to detect permanent failures of individual nozzles that may be caused, for example, by the failure of heating elements (in thermal ink jets) or by the failure in the piezo-electric crystals (in impulse printers). Other examples are related to detection of nozzles which have failed to eject drops because of de-priming (losing detection devices may also be used to calibrate the nozzle position relative to other parts of the printing machine.

Typically only high end printing systems have a drop detection system due to cost constraints. Consequently, growing complexity of printheads and harsh competition in printer costs and performance require new solutions for improvement in speed and printed image quality.

DETAILED DESCRIPTION

Figure 1:
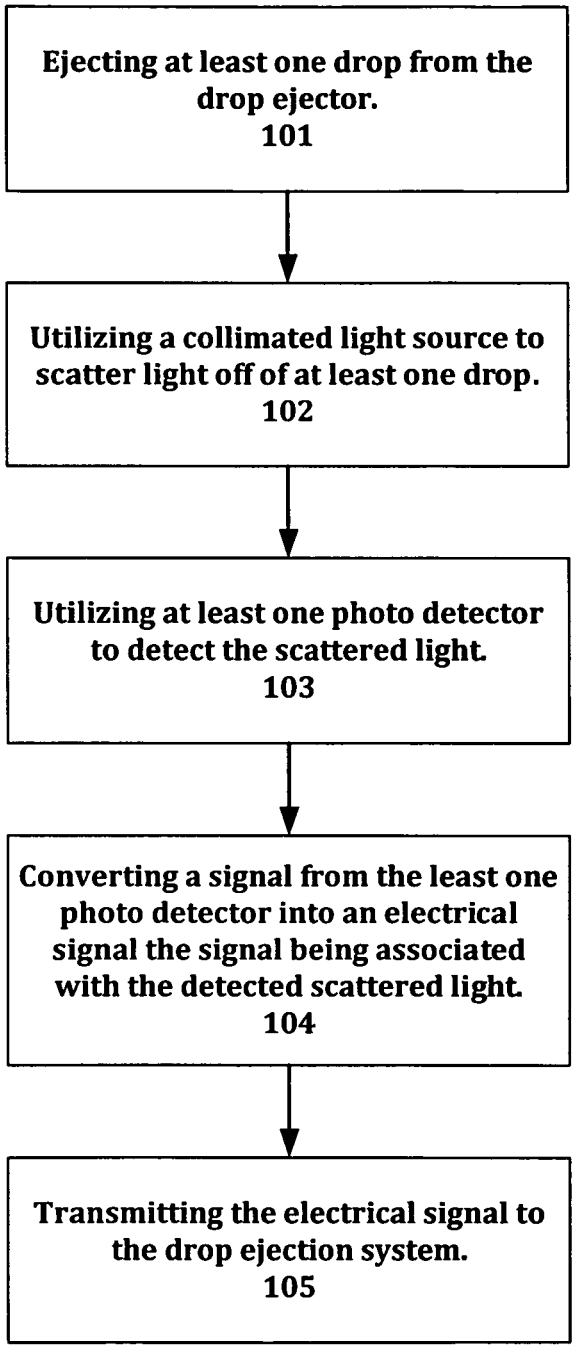
FIG. 1 is a high-level flowchart of a method in accordance with an embodiment.

As shown in the drawings for purposes of illustration, a drop detection mechanism and method of use thereof is disclosed. In an embodiment, a shaped laser beam is employed to scatter light off of ink drops that are fired from a plurality of nozzles. A low cost, high throughput detector is utilized to detect the individual drops and thereby calculate the drop count, drop velocity and other drop characteristics. Consequently, through the use of the below described embodiments, new levels of print image quality are enabled on a broad range of inkjet printers, including industrial and web printers.

FIG. 1 is a flowchart of a method in accordance with an embodiment. A first step 101 involves ejecting at least one drop from the drop ejector. A second step 102 involves utilizing a collimated light source to scatter light off of the at least one drop. A next step 103 includes utilizing at least one photo detector to detect the scattered light. Step 104 includes converting a signal from the least one photo detector into an electrical signal the signal being associated with the detected scattered light. A final step 105 includes transmitting the electrical signal to the drop ejection system.

Figure 2:
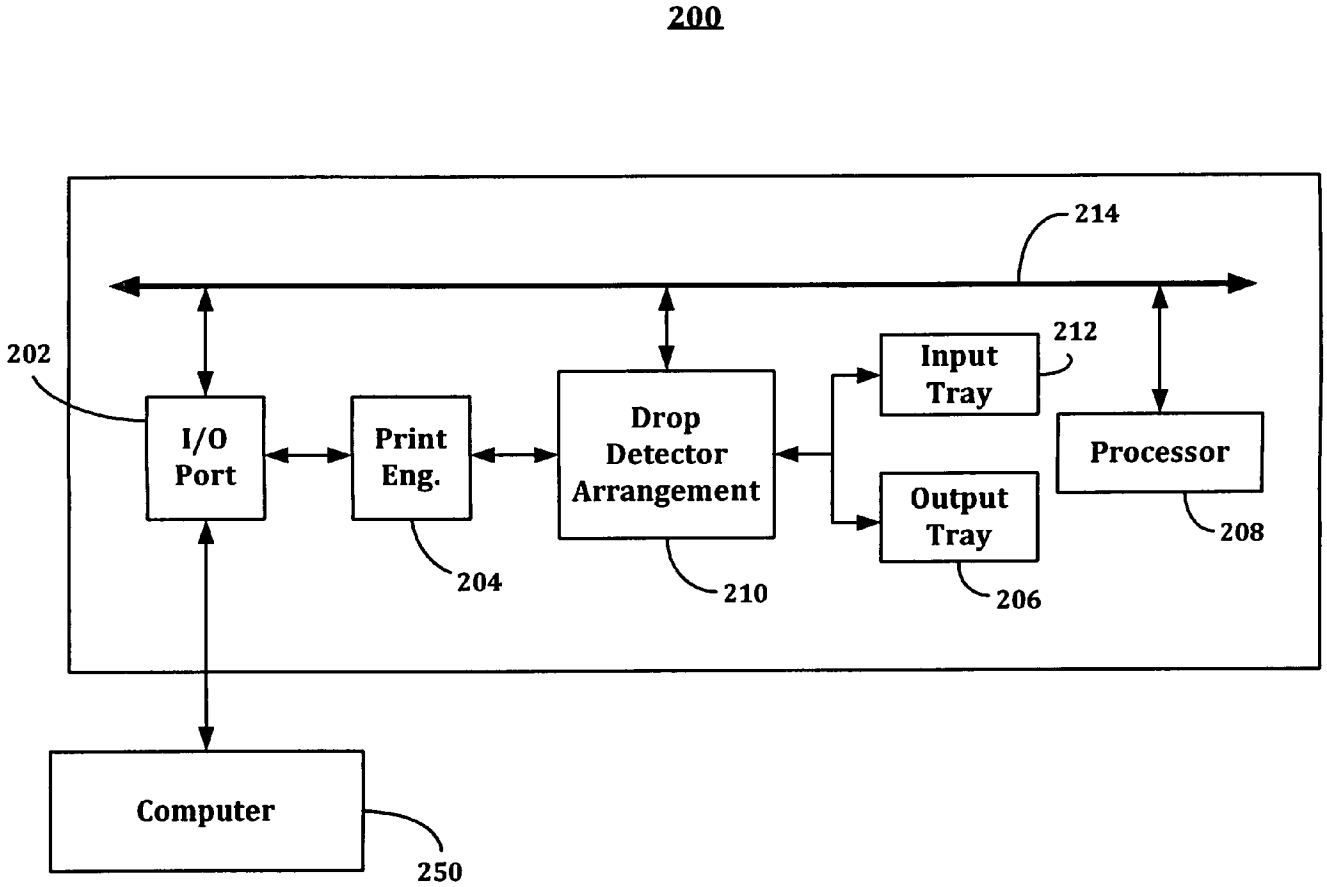
FIG. 2 is an exemplary drop ejection system in accordance with an embodiment.

Referring to FIG. 2, an exemplary drop ejection system 200 is illustrated. The depicted drop ejection system 200 includes an input/output (I/O) port 202, print engine 204, input tray 206, output tray 208 and a drop detector arrangement 210. System 200 additionally includes a processor 212, such as a microprocessor, configured to control functions of drop ejection system 200. Processor 212 communicates with other hardware elements of drop ejection system 200 via bus 214.

I/O port 202 includes an input/output device adapted to couple with a host computer 250. Print engine 204 is coupled to bus 214 and provide print output capability for the system 200. Sheet media is pulled from input tray 206 into print engine 204 and subsequently directed to output tray 208.

During a print operation, the processor 212 determines the location where the ink drops are to be deposited on the underlying print media and sends this data to the print engine 204. The print engine controller 204 receives the data associated with the print operation from the processor 212 and controls the print engine 206. The print engine 206 controls a print carriage (not shown) based on the data received. The exact location information of the ink droplets is contained in the print data. Accordingly, the print carriage deposits ink droplets on an underlying print media based on the print data received from the processor 212.

Figure 3:
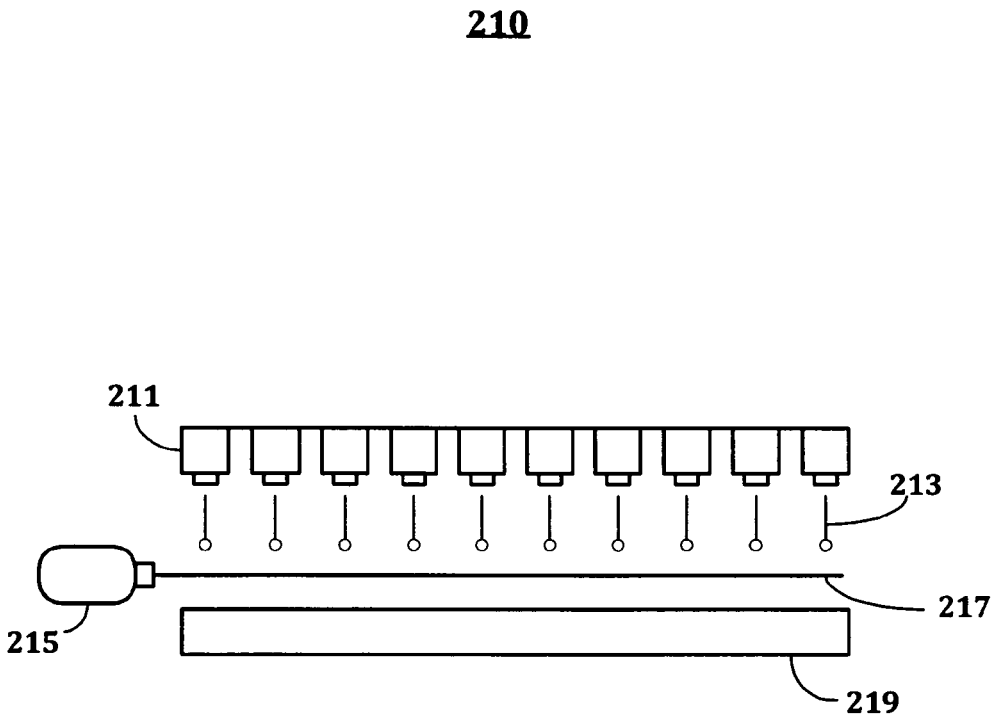
FIG. 3 is a drop detector arrangement in accordance with an embodiment.

In an embodiment, the system 200 also includes a drop detector arrangement 210. For a better understanding of the drop detector arrangement 210, please refer now to FIG. 3. The drop detector arrangement 210 includes a plurality of drop ejectors 211, each ejector capable of dispensing an ink droplet 213 and a collimated light source 215 for dispensing a beam of light 217. Also shown is a service station 219 for receiving the ink droplets 213. In an embodiment, the drop ejectors 211 are print head nozzles or the like.

In an embodiment, the collimated light source 215 is a laser diode device or the like. The shape of the light beam 217 can be circular, elliptical, rectangular or any other of a variety of shapes. Furthermore, the collimated light source 215 may work in conjunction with a light collection device and photo detector in an alternate embodiment shown in FIG. 4.

Figure 4:
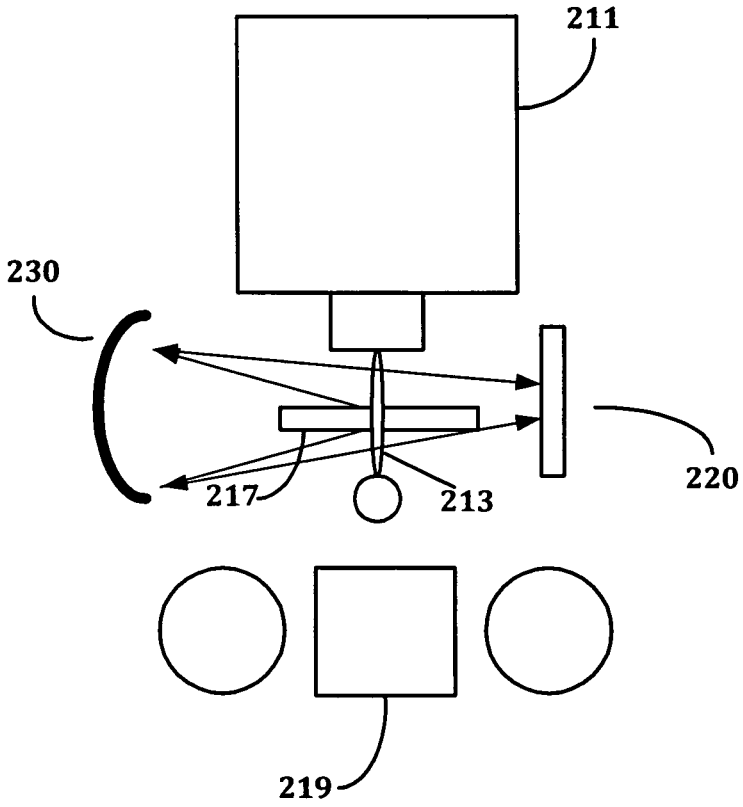
FIG. 4 shows an exemplary view of the drop detector arrangement in accordance with an alternate embodiment.

FIG. 4 shows an exemplary view of the alternate embodiment of the drop detector arrangement 210. FIG. 4 shows the drop ejector 211, the ink droplet 213, the light beam 217, and the service station 219. Also shown is a photodetector 220 and a light collection device 230. The light collection device 230 can be a lens, a mirror or the like capable of directing (e.g. reflecting) the light scattered off of the droplet 213 to the photodetector 220.

Figure 5:
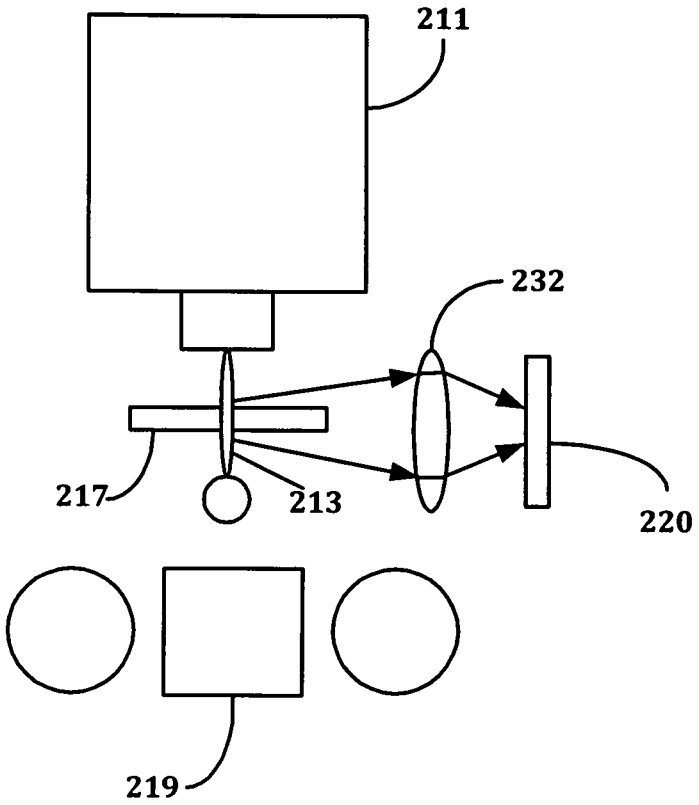
FIG. 5 shows an exemplary view of the drop detector arrangement in accordance with an alternate embodiment.

In an alternate embodiment, a refractive lens can be used to direct the light scattered off of the droplet. FIG. 5 shows the drop ejector 211, the ink droplet 213, the light beam 217, and the service station 219. Also shown is a photodetector 220 and a refractive lens 232.

Figure 6:
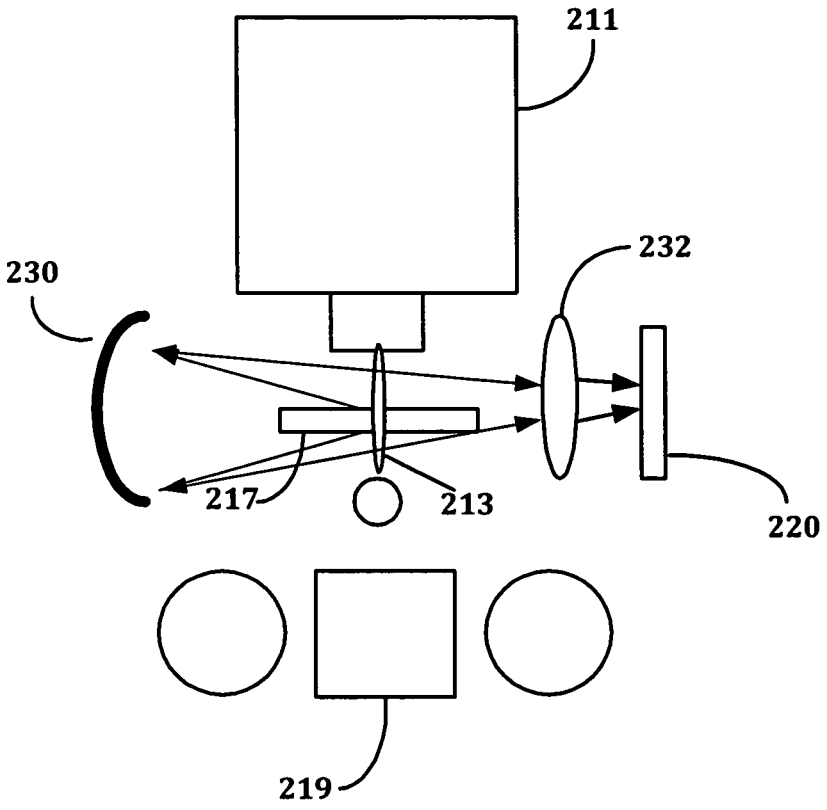
FIG. 6 shows an exemplary view of the drop detector arrangement in accordance with an alternate embodiment.

In yet another embodiment, a combination of reflective and refractive optics can be employed. FIG. 6 shows the drop ejector 211, the ink droplet 213, the light beam 217, and the service station 219. Also shown is a photodetector 220, a reflective lens 230 and a refractive lens 232.

In an embodiment, the photodetector 220 may be a CCD array. Typically the CCD array 220 may have a plurality of cells that provide the sensing functions. The CCD array 220 by means of the plurality of cells detects the light in its various intensities. Each ink drop 213 is identified from the detected light intensity of a group of one or more cells of the CCD array 220.

Based on the various light intensities the CCD electronics determines ink drop characteristics such as the presence and/or absence of ink drops, the size of the drops, and the falling angle of the ink drops. A predetermined low threshold light intensity may indicate the presence of an ink drop 213. Similarly, a predetermined high threshold may indicate the absence of an ink drop 213. Light intensities may also indicate other ink drop characteristics such as, size, position and speed.

Accordingly, the microprocessor 212 associated with the CCD array 220 may determine the status of the drop ejectors 211 based on the characteristics of the ink drops 213. For instance, the absence of an ink drop 213 may indicate that a nozzle failed to fire or is misfiring. The presence an ink drop 213 may indicate that the nozzle is firing. The size of the ink drop provides further information pertaining to the working status of the nozzle. An ink drop 213 that is smaller than usual indicates that a particular nozzle may be partially clogged or misfiring. The location of an ink drop 213 may also provide further information. An ink drop 213 that is in an unusual position or angle may suggest that the nozzle is skewed.

An ink drop flying across a laser beam generates a continuous optical signal with time proportional to beam width and reciprocal of drop speed. For a typical drop speed of approximately 10 m/sec and a 1 mm laser beam, the drop's time of flight is 100 μsec. Consequently, a single channel photocell is capable of detecting between 5,000-8,000 drop events per second. With a 0.1 mm laser beam, the same detector is capable of detecting between 50,000-80,000 drop-events per second. Accordingly, the servicing of a typical printhead may be accomplished in 5-10 seconds. The implementation of a photocell array could further decrease the service time.

Although the system 200 is described in conjunction with above-delineated components, it should be noted that the system 200 is an exemplary system. One of ordinary skill in the art will readily recognize that a variety of different components could be employed while remaining within the spirit and scope of the inventive concepts. For example, the drop detector arrangement 210 is illustrated in conjunction with a computer printer, however the drop detector arrangement 210 could be implemented with any of a variety of drop ejection systems while remaining within the spirit and scope of the present invention.

Figure 7:
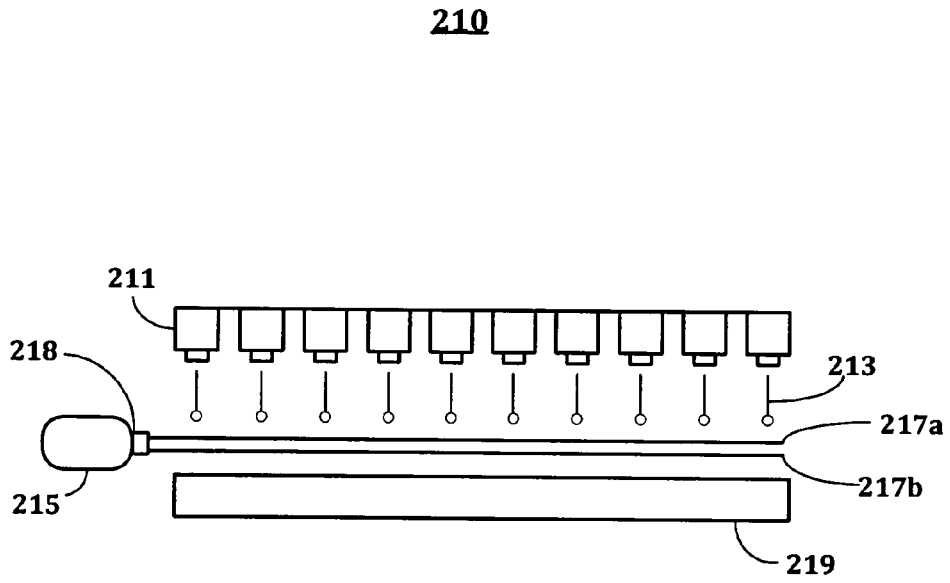
FIG. 7 shows an exemplary view of the drop detector arrangement in accordance with an alternate embodiment.
Figure 8:
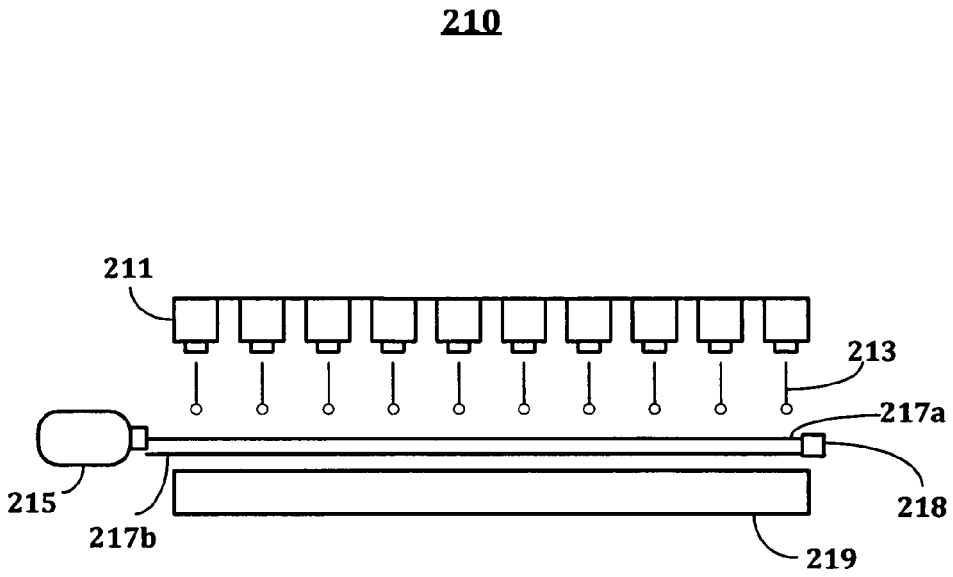
FIG. 8 shows an exemplary view of the drop detector arrangement in accordance with an alternate embodiment.
Figure 9:
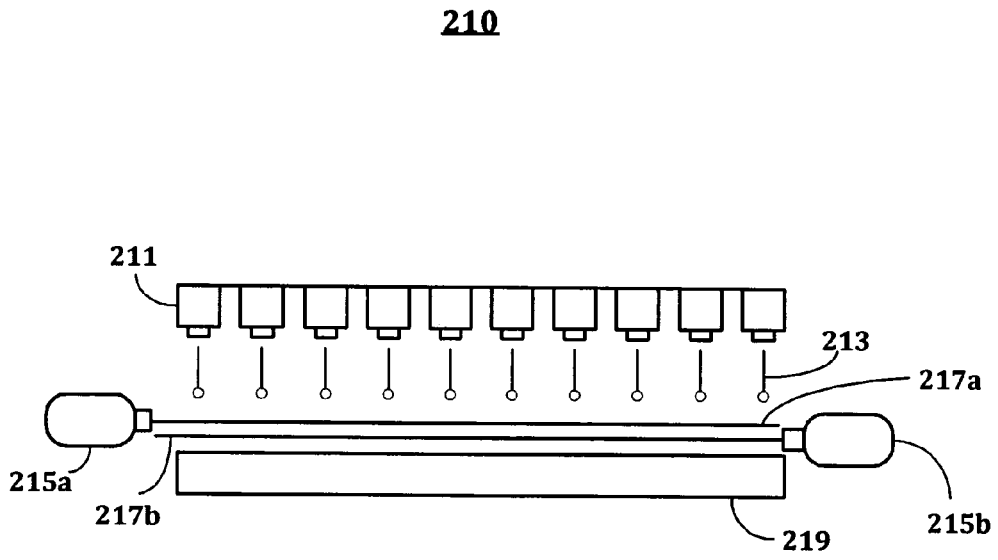
FIG. 9 shows an exemplary view of the drop detector arrangement in accordance with an alternate embodiment.

In another embodiment, the drop detector arrangement includes multiple laser sources. FIGS. 7-9 show varying embodiments of a drop detector arrangement that includes a multiple laser sources. FIG. 7 shows an embodiment whereby the laser source 215 includes an integrated beam splitter 218 thereby creating multiple light beams 217*a*, 217*b*. FIG. 8 shows an embodiment that incorporates a stand-alone beam splitter 218 for creating multiple light beams 217*a*, 217*b*. FIG. 9 shows an embodiment that incorporates two lasers sources 215*a*, 215*b* whereby each laser source 215*a*, 217*a* emits a respective laser beam 217*a*, 217*b*.

A drop detection mechanism and method of use thereof is disclosed. In an embodiment, a shaped laser beam is employed to scatter light off of ink drops that are fired from a plurality of nozzles. A low cost, high throughput detector is utilized to detect the individual drops and thereby calculate the drop count, drop velocity, turn on energy and other drop characteristics. The drop detector may even enable optimization of driving conditions for every nozzle by creating of printhead lookup table. Consequently, through the use of the below described embodiments, new levels of print image quality are enabled on a broad range of inkjet printers, including industrial and web printers.

Without further analysis, the foregoing so fully reveals the gist of the present inventive concepts that others can, by applying current knowledge, readily adapt it for various applications without omitting features that, from the standpoint of prior art, fairly constitute essential characteristics of the generic or specific aspects of this invention. Therefore, such applications should and are intended to be comprehended within the meaning and range of equivalents of the following claims. Although this invention has been described in terms of certain embodiments, other embodiments that are apparent to those of ordinary skill in the art are also within the scope of this invention, as defined in the claims that follow.

The invention claimed is:

1. A drop detection mechanism for a drop ejection system, the drop detection mechanism comprising:

at least one photo detector configured to detect a plurality of ejected drops;

at least one collimated light source for scattering light off of the plurality of ejected drops as the ejected drop passes substantially perpendicularly through a light beam from the collimated light source; and at least one collector device for directing the scattered light to the at least one photo detector and configured such that no light is collected directly from the collimated light source without first being scattered off an ejected drop.

2. The drop detection mechanism of claim 1 wherein the at least one photo detector comprises an array of photo detectors.

3. The drop detection mechanism of claim 1 wherein the at least one collimated light source comprises a laser source.

4. The drop detection mechanism of claim 1 wherein the at least one collimated light source comprises a plurality of laser sources.

5. The drop detection mechanism of claim 1 wherein the collector device comprises a lens.

6. The drop detection mechanism of claim 1 wherein the collector device comprises a mirror.

7. A drop detection arrangement comprising:

a plurality of drop ejectors;

drop detection means configured to detect a plurality of ejected drops from the plurality of drop ejectors, the drop detection means comprising:

collimated light source means for generating a light beam in a first direction for scattering light off of the at least one ejected drop as it passes through the light beam is a second direction that is substantially perpendicular to the first direction;

photo detection means configured to detect the plurality of ejected drops; and collection means configured to direct the scattered light to the at least one photo detector and configured such that no light is collected directly from the collimated light source;

wherein the intensity of the scattered light directed to the at least one photo detector is indicative an ejected drop.

8. The drop detection arrangement of claim 7 wherein the photo detection means comprises an array of photo detectors.

9. The drop detection arrangement of claim 7 wherein the collimated light source means comprises a laser source.

10. The drop detection arrangement of claim 7 wherein the collimated light source means comprises a plurality of laser sources.

11. The drop detection arrangement of claim 7 wherein the collection means comprises a mirror.

12. The drop detection arrangement of claim 7 wherein the collection means comprises a lens.

13. A method of detecting drop ejections in a drop ejection system the drop ejection system including a plurality of drop ejectors and a microprocessor, the method comprising:

ejecting a plurality of drops from the plurality of drop ejectors;

utilizing a collimated light source to scatter light off of the plurality of drops as the drops pass substantially perpendicularly through a light beam from the collimated light source;

utilizing at least one photo detector to detect the scattered light and without collecting light directly from the collimated light source;

converting a signal from the least one photo detector into an electrical signal the signal being associated with the detected scattered light; and transmitting the electrical signal to the microprocessor.

14. The method of claim 13 wherein utilizing a collimated light source further comprises:

utilizing a laser source to scatter light off of the plurality of drops.

15. The method of claim 13 wherein utilizing a collimated light source further comprises:

utilizing a plurality of laser sources to scatter light off of the plurality of drops.

16. The method of claim 13 wherein utilizing at least one photo detector further comprises:

utilizing a plurality of photo detectors to detect the scattered light.

17. The method of claim 13 wherein utilizing at least one photo detector to detect the scattered light further comprises:

utilizing a collecting device to direct the scattered light to the photo detector.

18. The method of claim 17 wherein utilizing a collecting device to direct the scattered light to the photo detector further comprises:

utilizing a mirror to direct the scattered light to the photo detector.

19. The method of claim 17 wherein utilizing a collecting device to direct the scattered light to the photo detector further comprises:

utilizing a lens to direct the scattered light to the photo detector.

* * * * *

UNITED STATES PATENT AND TRADEMARK OFFICE

CERTIFICATE OF CORRECTION

PATENT NO. : 8,529,011 B2
APPLICATION NO. : 12/079338
DATED : September 10, 2013
INVENTOR(S) : Govyadinov It is certified that error appears in the above-identified patent and that said Letters Patent is hereby corrected as shown below:

In the Claims

Column 5, line 1, in Claim 7, delete first occurrence of "is" and insert -- in --, therefor.

Column 6, line 1, in Claim 13, delete "least" and insert -- at least --, therefor.

Signed and Sealed this
Nineteenth Day of November, 2013

Teresa Stanek Rea

Teresa Stanek Rea
*Deputy Director of the United States Patent and Trademark Office*